US011535340B2

(12) United States Patent
Knopp

(10) Patent No.: US 11,535,340 B2
(45) Date of Patent: Dec. 27, 2022

(54) ANCHOR WINCH SYSTEM

(71) Applicant: Aaron J. Knopp, Parrish, FL (US)

(72) Inventor: Aaron J. Knopp, Parrish, FL (US)

( * ) Notice: Subject to any disclaimer, the term of this patent is extended or adjusted under 35 U.S.C. 154(b) by 119 days.

(21) Appl. No.: 17/185,627

(22) Filed: Feb. 25, 2021

(65) Prior Publication Data

US 2022/0266955 A1 Aug. 25, 2022

(51) Int. Cl.
*B63B 21/16* (2006.01)
*B63B 21/22* (2006.01)

(52) U.S. Cl.
CPC ..... *B63B 21/16* (2013.01); *B63B 21/22* (2013.01)

(58) Field of Classification Search
CPC ..... B63B 21/04; B63B 21/10; B63B 21/16; B63B 21/18; B63B 21/20; B63B 21/22
USPC ..... 114/199, 210, 268, 293, 294; 254/339, 254/365, 371
See application file for complete search history.

(56) References Cited

U.S. PATENT DOCUMENTS

| | | | | |
|---|---|---|---|---|
| 6,394,421 | B1 * | 5/2002 | Henly | B66D 1/7415 254/365 |
| 6,595,493 | B2 | 7/2003 | Krebs et al. | |
| 6,708,954 | B2 * | 3/2004 | Chambers | B66D 1/72 254/339 |
| 7,520,490 | B1 | 4/2009 | Lee | |
| 8,342,484 | B2 * | 1/2013 | Matos | B66D 1/72 254/371 |
| 2003/0107030 | A1 | 6/2003 | Sozzi | |
| 2014/0239871 | A1 | 8/2014 | Savva et al. | |

* cited by examiner

*Primary Examiner* — Daniel V Venne

(57) ABSTRACT

An anchor winch system includes a support arm, an end effector, a guide channel, a winch, a cable and an anchor. The anchor winch system enables a user to deploy an anchor that is stored within the C or Z channels of a pontoon or tritoon boat. The support arm is mounted along the C or Z channel and the end effector is mounted onto an end of the support arm. The end effector is a holding apparatus that retains the anchor in a stowed position when not deployed. The guide channel traverses through the support arm, and the cable is threaded through the guide channel. The winch is tethered to one end of the cable and the anchor is tethered to the opposite end. Thus, the winch is able to deploy or retract the anchor by paying out or reeling in the cable.

13 Claims, 17 Drawing Sheets

ANCHOR WINCH SYSTEM

FIELD OF THE INVENTION

The present invention relates generally to anchors. More specifically, the present invention relates to an anchor winch system with an anchor-holding bracket.

BACKGROUND OF THE INVENTION

Pontoon and tritoon boats frequently need to be anchored in place. Because of this requirement, boaters have come up with multiple solutions for holding their boats in place. These solutions include anchors attached to chains and ropes. Some systems even employ mechanical assistance to draw up the anchor once deployed. However, these systems are frequently exposed to the elements and become damaged. Additionally, these anchoring systems are often bulky and take up space on the deck.

The present invention is an anchor winch system that addresses these shortcomings. To achieve this functionality, the present invention employs a system that may be integrated into the C or Z Channel crossmembers of the boat. This protects the winch and other components from exposure to conditions at sea. Further, the present invention may be mounted beneath the boat to save deck space. Further, the present invention provides a system for mounting a waterproof drum anchor winch between the pontoons of a pontoon or tritoon boat. The present invention enables a user to retrofit the pontoon or tritoon boat with an out of the way anchoring system that does not clutter the deck of the boat. In these embodiments, the present invention can be encased in a waterproof housing that limits exposure to water and other hazards in the environment. The present invention makes use of an end effector to retain the anchor in a stowed position. Thus, limiting the chance that the anchor will be dislodged inadvertently. Further, the present invention provides a system for mounting a waterproof drum anchor winch between the pontoons of a pontoon or tritoon boat. The present invention enables a user to retrofit the pontoon boat with an out of the way anchoring system that does not clutter the deck of the boat.

DETAIL DESCRIPTIONS OF THE INVENTION

Figure 1:
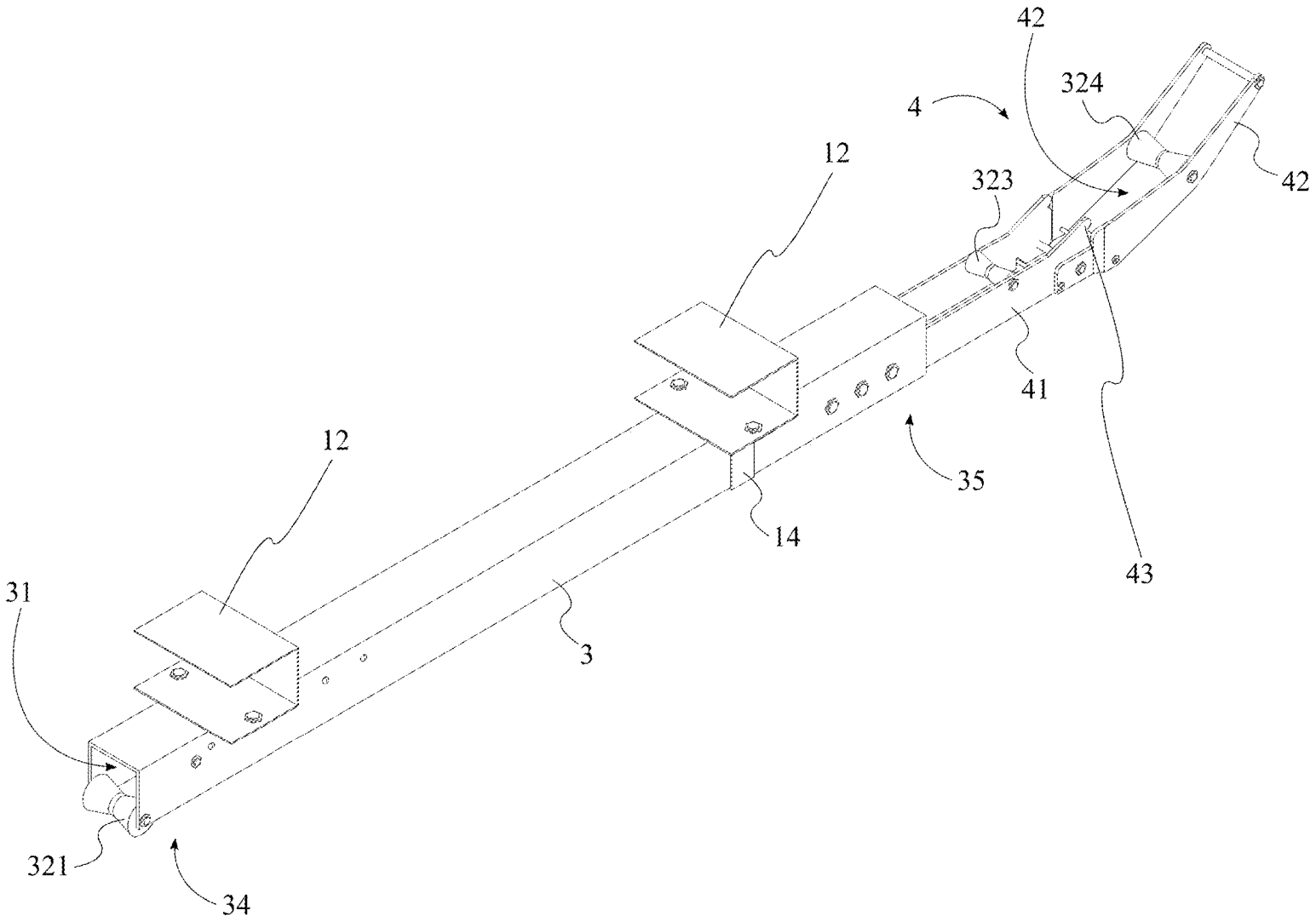
FIG. 1 is an isometric perspective view of the present invention.

All illustrations of the drawings are for the purpose of describing selected versions of the present invention and are not intended to limit the scope of the present invention.

Referring to FIG. 1 through FIG. 17, the preferred embodiment of the present invention, the anchor winch system is a device used to deploy and stow an anchor. Preferably, the present invention is a robust system designed to resist degradation after extended exposure to moisture and corrosive substances. Additionally, the present invention is intended to be integrated into underside of a boat. The term boat is used herein to refer to watercraft selected from the group including, but not limited to boats, ships, pontoons, tritoons, hovercraft, and submarines. Accordingly, the present invention is designed to be mounted onto the C or Z channel of a pontoon or tritoon. Further, the present invention is designed to be a low-profile device that enables an anchor to be inconspicuously stored. To achieve the above-described functionality, the present invention comprises a winch 1, a cable 2, a support arm 3, an end effector 4, a guide channel 31, and an anchor 5. The support arm 3 acts as the primary structural component of the present invention an enables the anchor 5 to be deployed at a desired location relative to the boat. The end effector 4 is mounted adjacent to a first end 35 of the support arm 3. Accordingly, the end effector 4 is able to retain the anchor 5 in a stowed configuration. The guide channel 31 longitudinally traverses through the support arm 3. Thus, creating a pathway through which the cable 2 is routed between the winch 1 and the anchor 5. More specifically, a first end 21 of the cable 2 is tethered to the winch 1, the cable 2 is threaded through the guide channel 31, and a second end 22 of the cable 2 is tethered to the anchor 5. As result, the winch 1 is able to deploy the anchor 5 at a given location without the cable 2 becoming tangled or damaged. The winch 1 is preferably a waterproof drum winch that is designed to be mounted on the underside of the boat. Further, the winch 1 is designed to be a waterproof, dustproof, and shock resistant device that resists corrosion and damage due to hazards in the external environment. Preferably, the winch 1 and the support arm 3 are communicably coupled to a control system that enables a user to direct the present invention to remotely deploy or stow the anchor 5 as well as actuate the support arm 3 and end effector 4. Further, embodiments of the present invention are equipped with a wireless communication system that enables the user to wirelessly communicate with and control the present invention.

Figure 2:
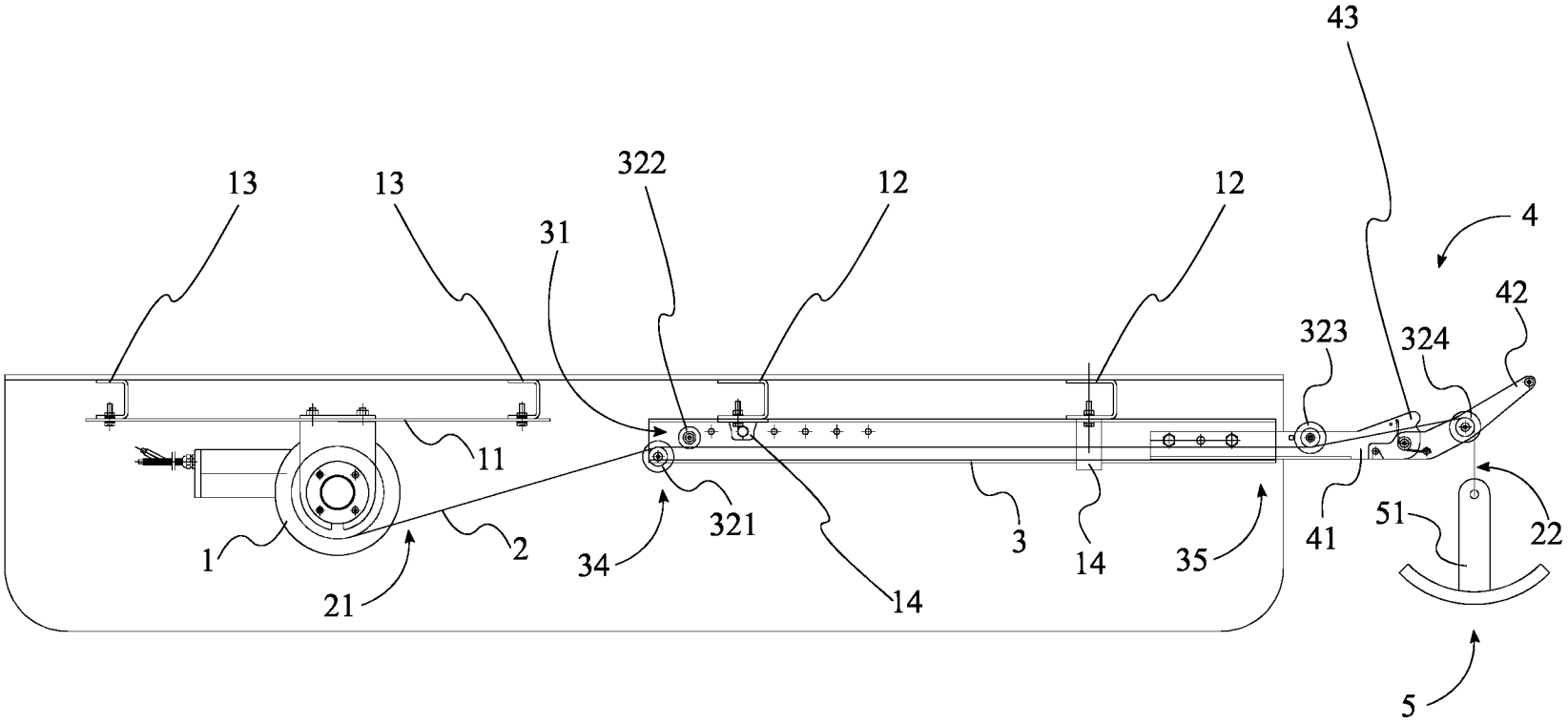
FIG. 2 is a schematic view of the present invention mounted within the hull of a boat.
Figure 3:
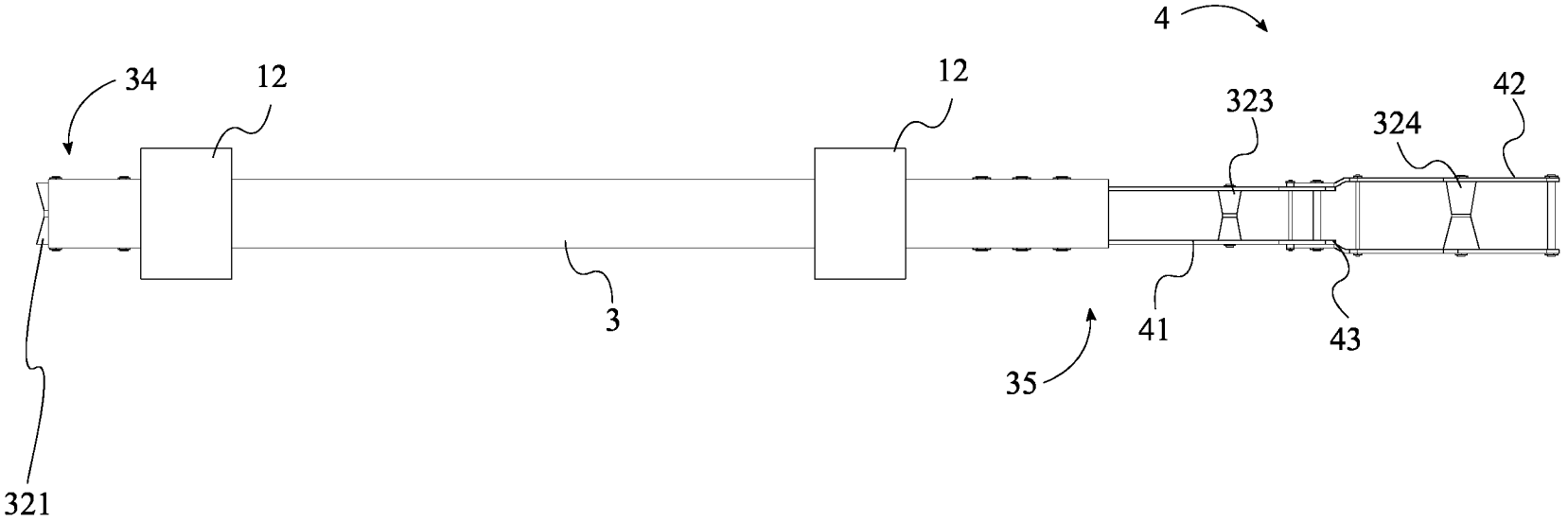
FIG. 3 is a top view of the present invention.

Referring to FIG. 2, to facilitate deploying the anchor 5 without damaging the cable 2, the present invention further comprises a plurality of guide rollers 32. The plurality of guide rollers 32 is mounted within the guide channel 31 and distributed along the guide channel 31. Further, the cable 2 is routed over the plurality of rollers so that the cable 2 does not rub against the edges of the support arm 3. Specifically, the plurality of guide rollers 32 comprises at least one lift roller 321 and at least one tensioning roller 322. The lift roller 321 is mounted adjacent to a second end 34 of the support arm 3, opposite to the end effector 4. Consequently, the lift roller 321 acts as a ramp that leads the cable 2 into the guide channel 31, preventing the cable 2 from becoming damaged due to abrasion by rubbing against the edges of the support arm 3. The tensioning roller 322 is mounted within the guide channel 31. Additionally, the tensioning roller 322 is positioned in between the lift roller 321 and the end effector 4. Further, the tensioning roller 322 is positioned opposite to the lift roller 321 across the guide channel 31. Finally, the cable 2 is threaded in between the lift roller 321 and the tensioning roller 322. As a result, the tensioning roller 322 ensures that the cable 2 is retained in a desired orientation within the guide channel 31.

Figure 9:
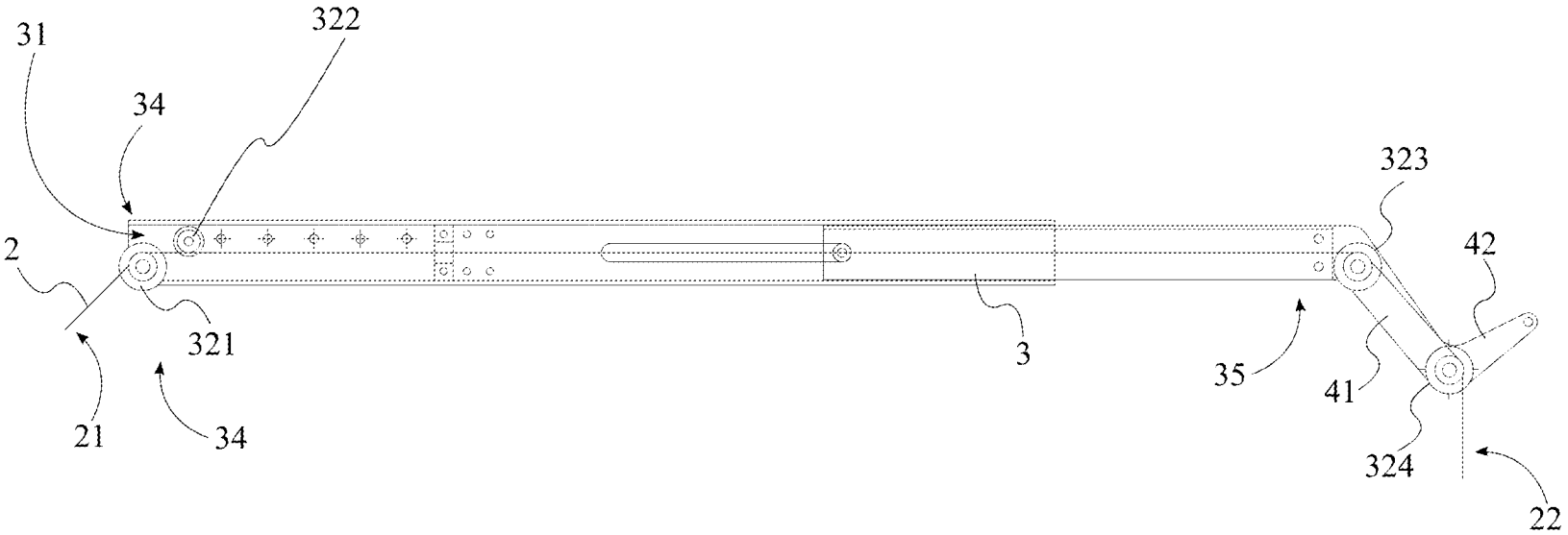
FIG. 9 is a schematic view of the separate embodiment present invention that features a length-adjustable support arm.

Referring to FIG. 2 and FIG. 9, the present invention is designed to securely store the anchor 5 when not in use. To that end, the end effector 4 comprises a first leg 41, a second leg 42, and an anchor-receiving hole 42. The first leg 41 is terminally mounted to the first end 35 of the support arm 3 and the second leg 42 is terminally mounted to the first leg 41, opposite to the support arm 3. Consequently, the first leg 41 and the second leg 42 form a bracket that supports the anchor 5 while stowed. The anchor-receiving hole 42 traverses through the second leg 42 so that a shank 51 of the of the anchor 5 is able to engage into the anchor-receiving hole 42 while stowed. This configuration ensures that the anchor 5 is not jostled or dislodged while in the stowed position. As the winch 1 reels in the cable 2, the anchor 5 is drawn up into the end effector 4 and the shank 51 is drawn through the anchor-receiving hole 42. Preferably, the term "end effector" is used herein to describe any mounting or bracketing system capable of retaining the anchor in a stowed position while the cable 2 is reeled in. Additionally, the term "end effector" describes a system that smoothly releases the anchor 5 when directed.

Figure 5:
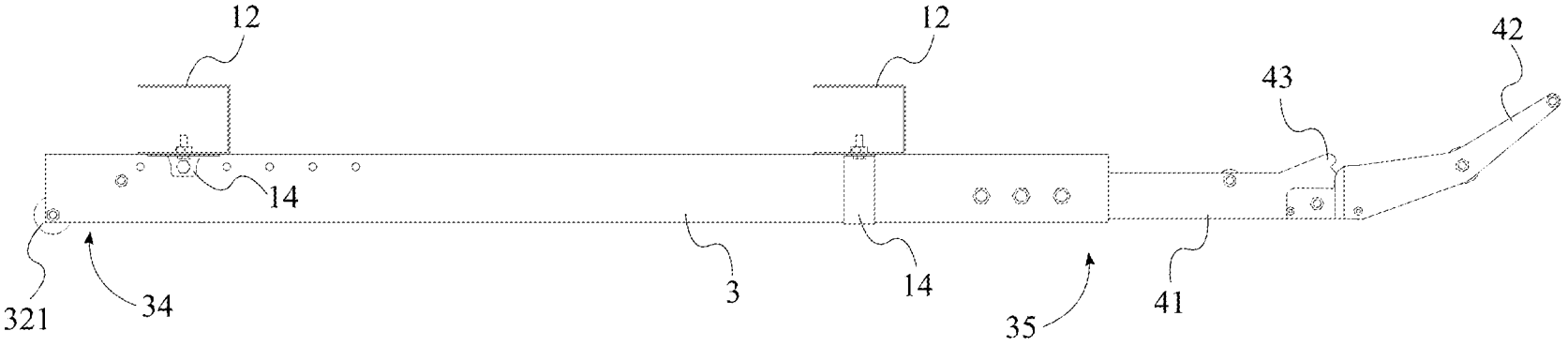
FIG. 5 is a right-side view of the present invention with the end effector in a deployed position.
Figure 6:
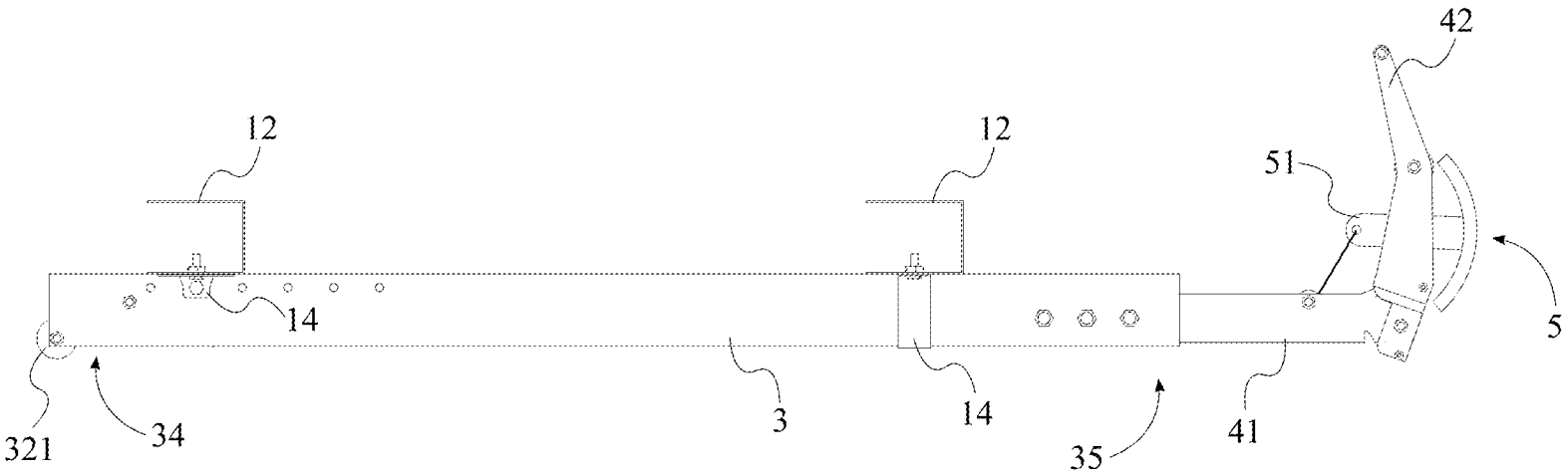
FIG. 6 is a right-side view of the present invention with the end effector in a stowed position.

Referring to FIG. 2, FIG. 5, and FIG. 9, as described above, the present invention is designed to prevent the cable 2 from becoming damaged or tangled. To that end, the present invention further comprises at least one directional roller 323 and at least one anchor-support roller 324. The directional roller 323 is mounted to the first leg 41. The anchor-support roller 324 is mounted onto the second leg 42 and positioned in between the anchor-receiving hole 42 and the first leg 41. Thus positioned, the directional roller 323 and the anchor-support roller 324 enable the cable 2 to be rerouted toward the desired direction regardless of the orientation of the end effector 4. Some embodiments of the present invention feature an articulated end effector 4 that can be repositioned to deploy or stow the anchor 5. To facilitate the above-described functionality, the second leg 42 is hingedly attached to the first leg 41. Further, in these embodiments the end effector 4 comprises a stopper 43 that is mounted adjacent to the first leg 41. As the winch 1 reels in the cable 2, the anchor 5 pushes the second leg 42 toward the first leg 41 and is restrained by the stopper 43. Once the cable 2 is completely reeled in, the winch 1 provides a tensioning force that retains the anchor 5 in the stowed position. In further embodiments, a locking mechanism is integrated into the end effector 4 such that the locking mechanism acts as a secondary safeguard that prevents the anchor 5 from becoming inadvertently dislodged. In supplemental embodiments, a biasing spring is integrated into the hinged connection between the second leg 42 and the first leg 41. The biasing spring enables the second leg 42 to be extended away from the first leg 41 when the tension on the cable 2 is released by the drum anchor winch 1 unwinding. Thus, allowing the second leg 42 to fall forward when deploying the anchor 5.

Figure 7:
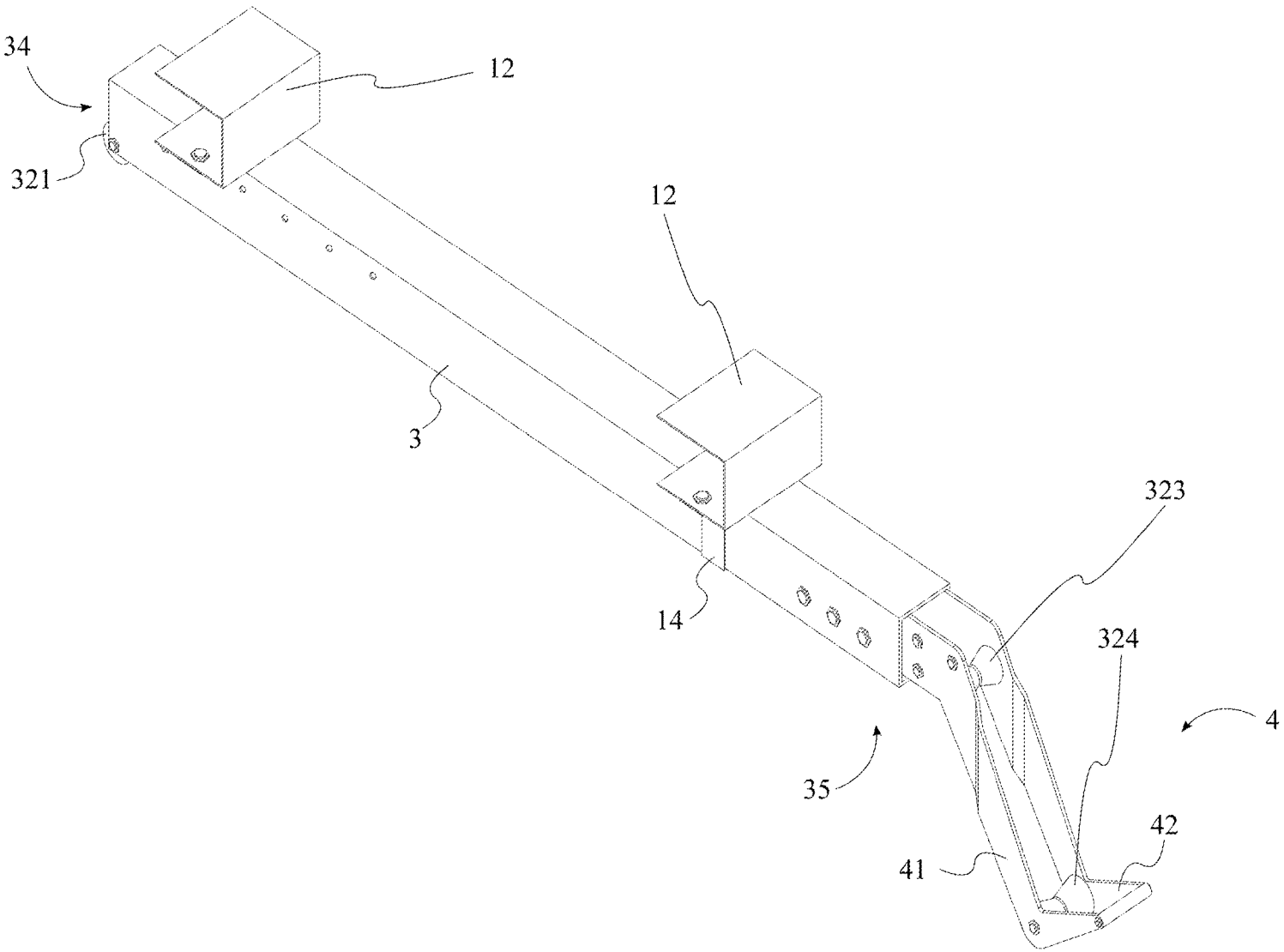
FIG. 7 is a front isometric perspective view of a separate embodiment of the present invention.
Figure 8:
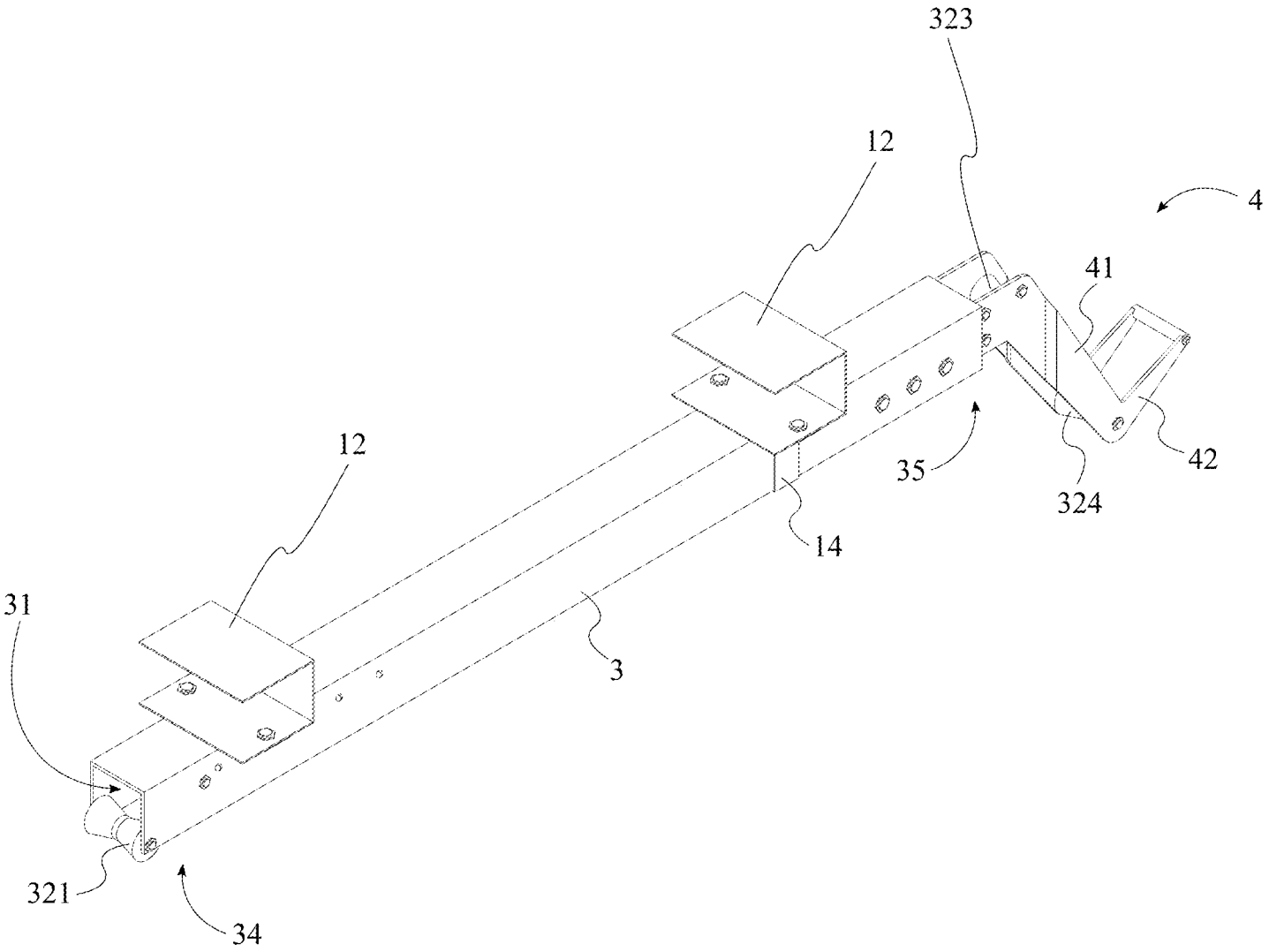
FIG. 8 is a rear isometric perspective view of a separate embodiment of the present invention.

Referring to FIG. 7, FIG. 8, and FIG. 9, in some embodiments, the end effector 4 is a rigid component that supports the anchor 5. In these embodiments, the first leg 41 is angularly offset from the support arm 3 and the second leg 42 is angularly offset from the first leg 41. Thus, forming a bracket against which the anchor 5 is braced while in the stowed position. In further embodiments the present invention is equipped with a length-adjustable support arm 3 that enables the end effector 4 to be laterally repositioned when deploying and stowing the anchor 5. In these embodiments the support arm 3 is a length-adjustable member that extends before deploying the anchor 5 and then retracts as the anchor 5 is reeled in. Further, an actuation mechanism may be integrated into the length-adjustable support arm 3 that enables the end effector 4 to be extended away from the winch 1 when the tension on the cable 2 is released by the drum anchor winch 1 unwinding. Thus, allowing the end effector 4 to be seen when deploying the anchor 5. Embodiments of the present invention use actuation mechanisms selected from the group including, but not limited to, springs, motors, and hydraulic cylinders.

Referring to FIG. 2 as described above, the present invention is designed to be inconspicuously stored within or beneath the C or Z Channel crossmembers of the boat. To facilitate this, embodiments of the present invention further comprise at least one mounting brace 14, a first plurality of standoffs 12, a base plate 11 and a second plurality of standoffs 13. The mounting brace 14 is laterally mounted to the support arm 3 so that the support arm 3 may be attached to external structures. The first plurality of standoffs 12 enables the support arm 3 to be retained in a desired position relative to the external structure. The winch 1 is mounted adjacent to the baseplate 11 and the second plurality of standoffs 13 is mounted adjacent to the baseplate 11, opposite to the winch 1. Accordingly, the baseplate 11 and the second plurality of standoffs 13 enable the winch 1 to be mounted onto the external structure. Preferably, the plurality of standoffs 13, the baseplate 11, and the mounting brace 14 enable the support arm 3 and the winch 1 to be mounted within the C-channel and the Z-channel of pontoons and tritoons. Further, this mounting configuration acts as a universal mounting system that enables the present invention to be detachably mounted to boats of varying shape and size. Additionally, some embodiments of the present invention include a camera that is mounted onto the baseplate 11 such that the user is able to view the deployment or retraction of the anchor 5 and winch 1 remotely.

Referring to FIG. 2 and FIG. 9, in supplemental embodiments, the first plurality of standoffs 12 and the second plurality of standoffs 13 act as shock absorbers that prevent the support arm 3 and the winch 1 from being jostled, thus preventing the anchor 5 from becoming unintentionally dislodged. Alternatively, the present invention can be mounted directly onto the C or Z channel crossmembers of a pontoon or tritoon frame. In these embodiments, the first plurality of standoffs 12 and the second plurality of standoffs 13 as shown in FIG. 2, may be replaced by the C or Z channel crossmembers of the pontoon or tritoon frame. In further embodiments, the present invention is encased in a waterproof housing that prevents the system from being exposed to moisture in the external environment. The waterproof housing may be equipped with a door that opens to enable the anchor 5 to be deployed and then closes to prevent extended exposure to hazards in the external environment.

Figure 10:
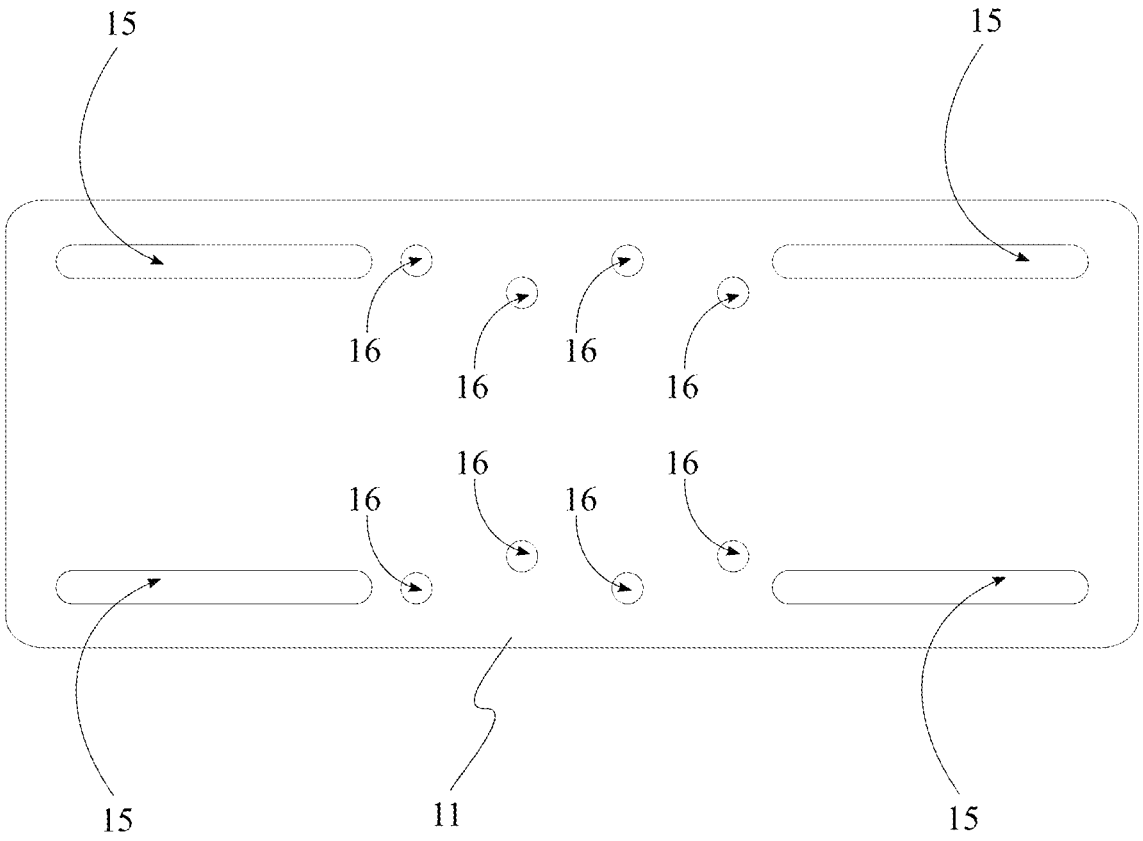
FIG. 10 is an isometric perspective view of the baseplate used in the present invention.
Figure 11:
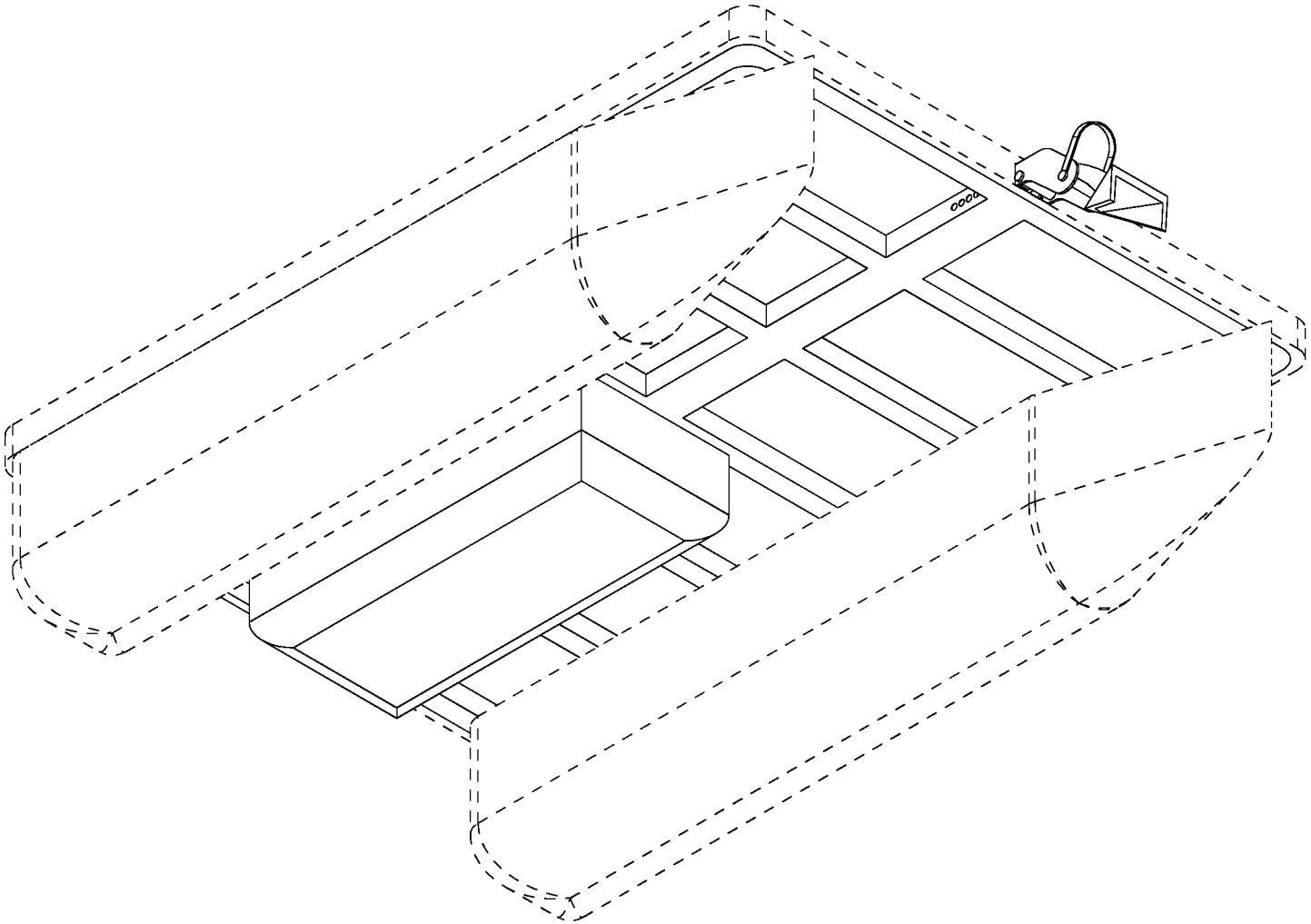
FIG. 11 is a bottom perspective view of an embodiment of the present invention being integrated into the C or Z channel cross member frame of the boat.
Figure 12:
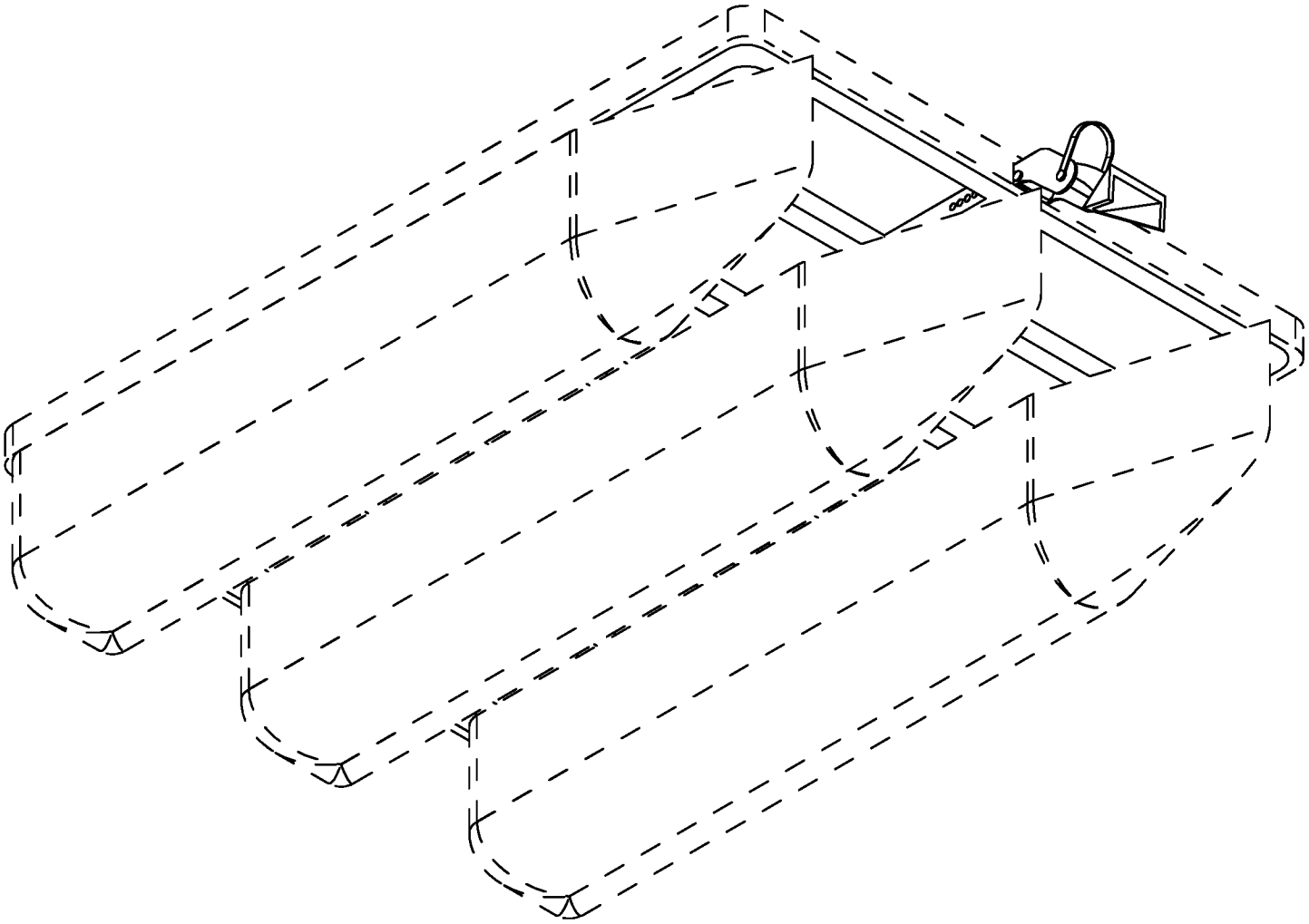
FIG. 12 is a bottom perspective view of an embodiment of the present invention being integrated into the C or Z channel cross member frame of the boat.
Figure 13:
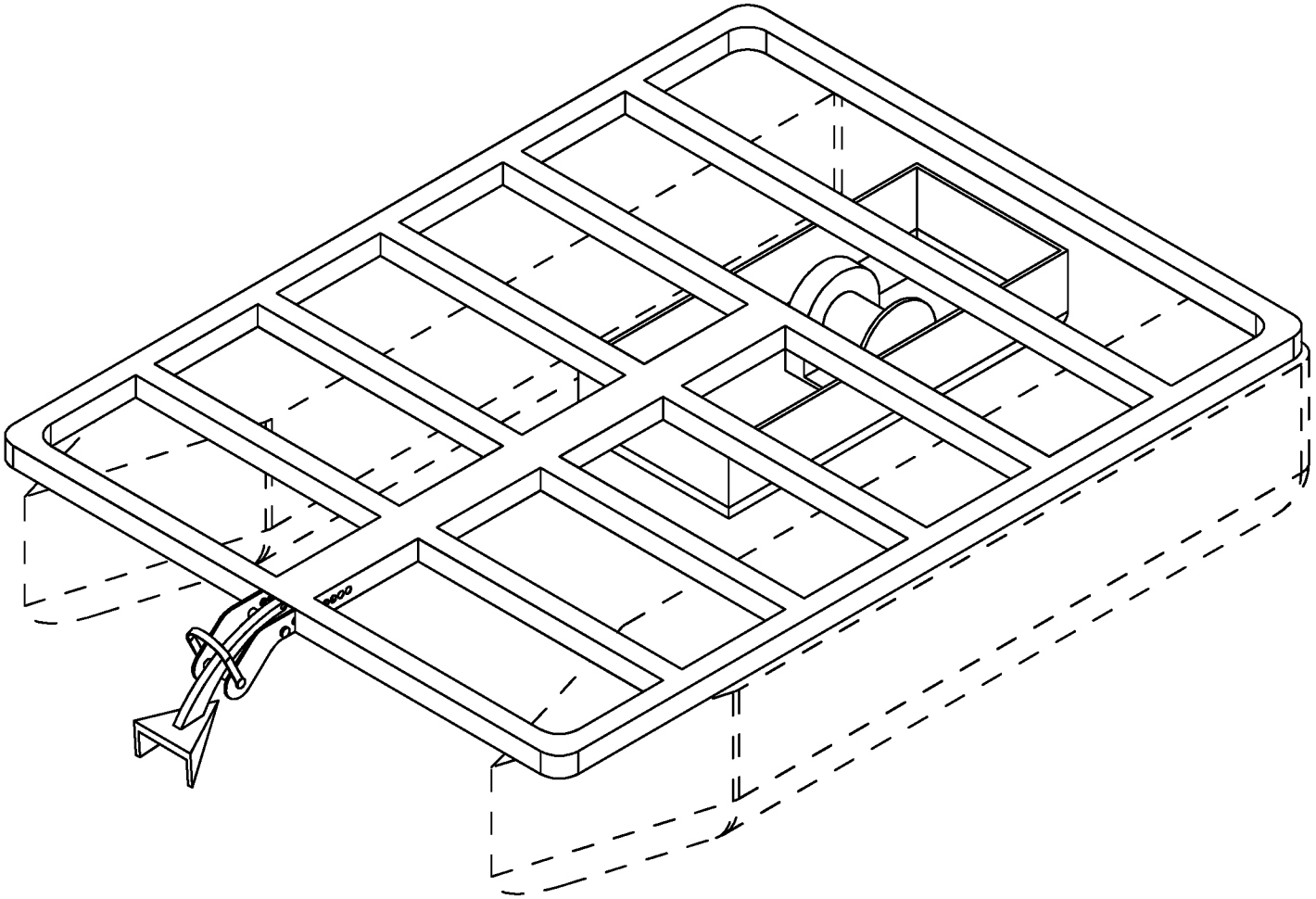
FIG. 13 is a top perspective view of an embodiment of the present invention being integrated into the C or Z channel cross member frame of the boat.
Figure 14:
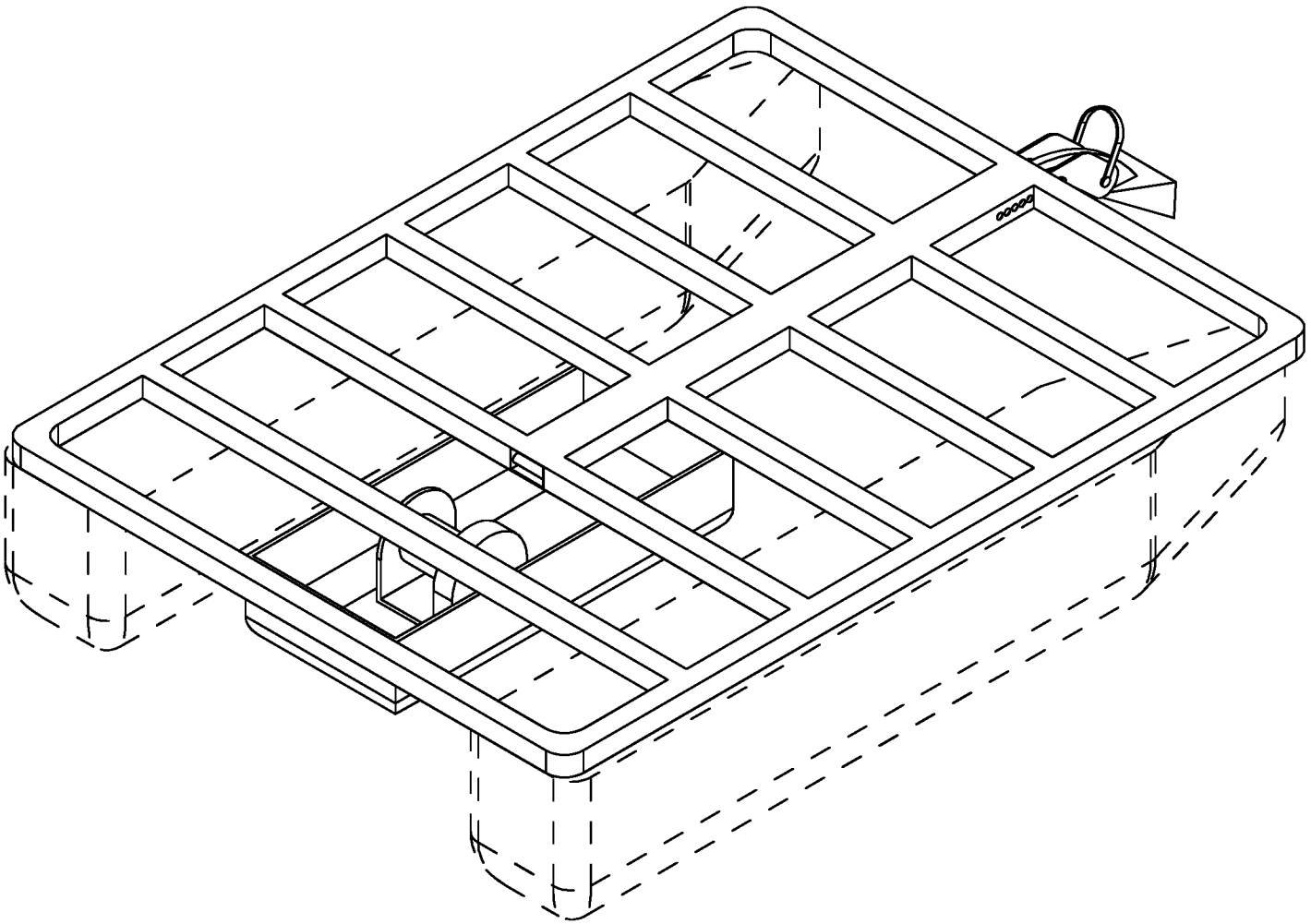
FIG. 14 is a top perspective view of an embodiment of the present invention being integrated into the C or Z channel cross member frame of the boat.
Figure 15:
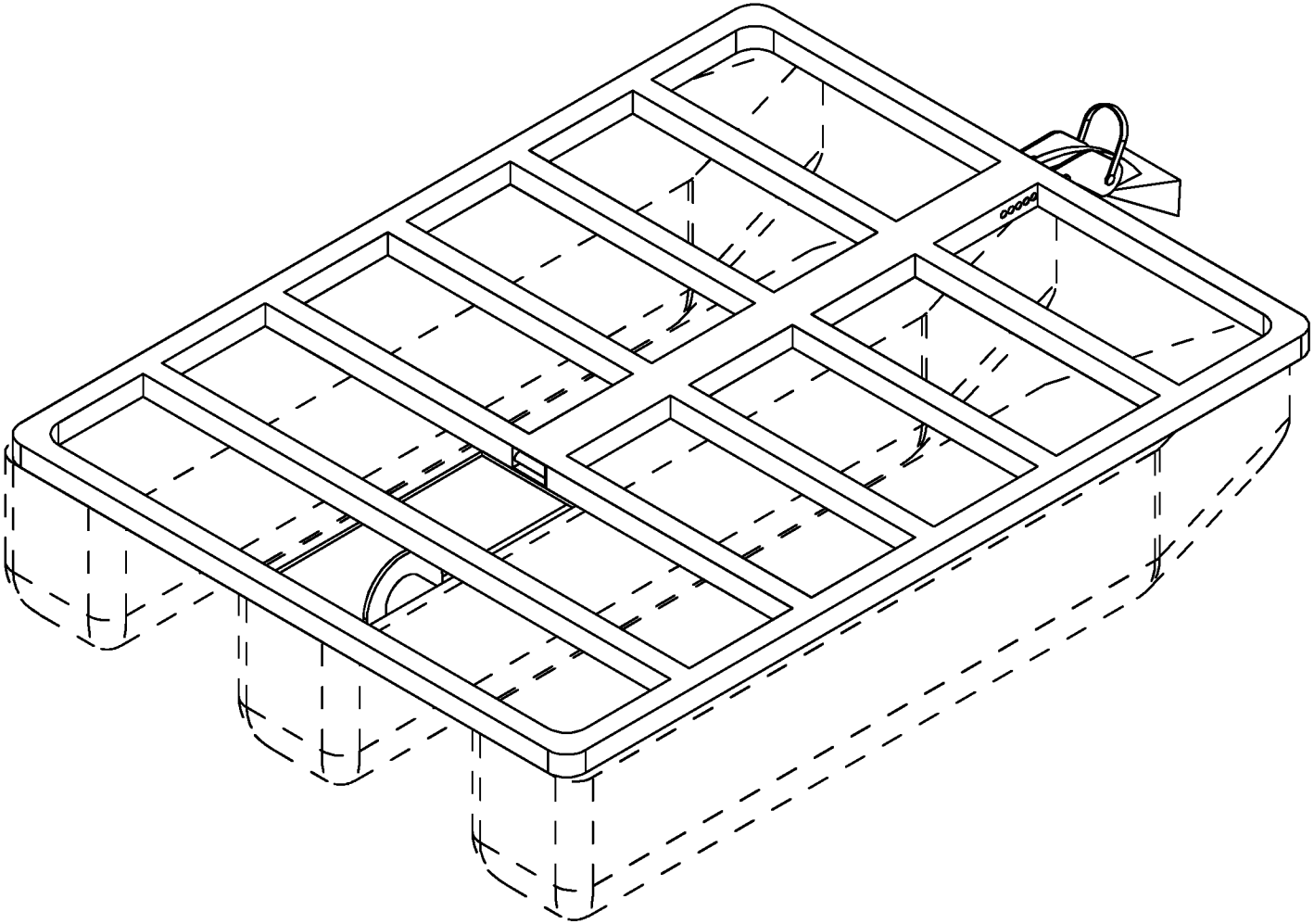
FIG. 15 is a top perspective view of an embodiment of the present invention being integrated bellow the deck of a tritoon.
Figure 16:
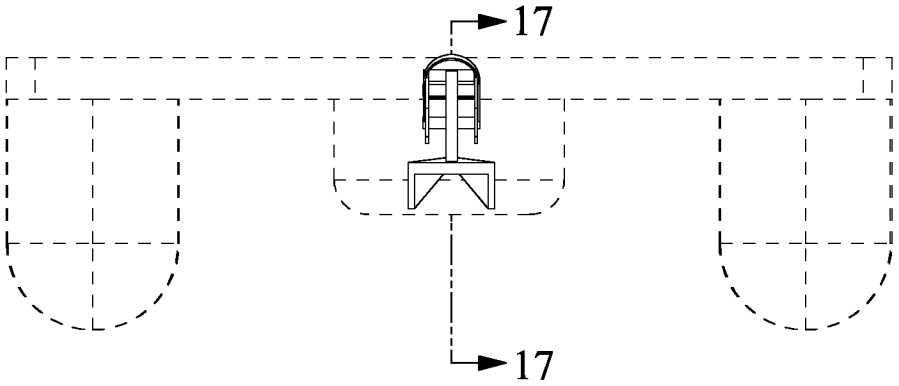
FIG. 16 is a top perspective view of an embodiment of the present invention being integrated bellow the deck of a pontoon.
Figure 17:
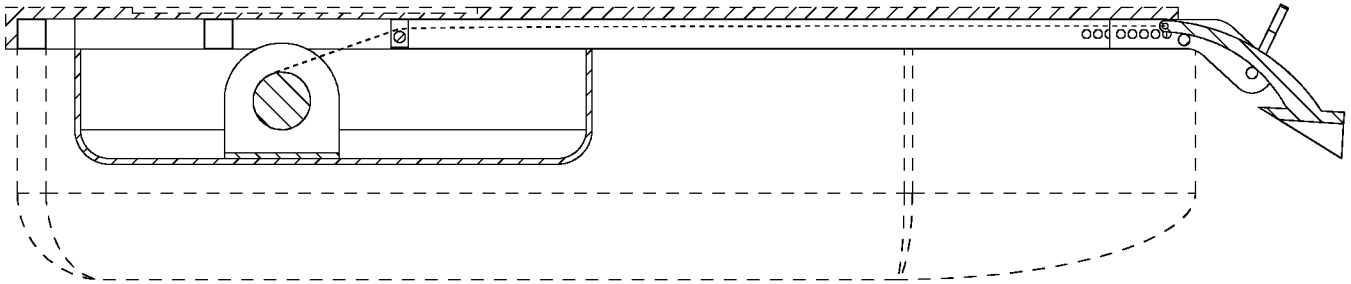
FIG. 17 is a side sectional view of an embodiment of the present invention taken along line 17-17 in FIG. 16.

Referring to FIG. 2 and FIG. 10, the present invention provides a system for mounting an anchoring system between the pontoons of a pontoon or tritoon boat. To mount the present invention beneath the pontoon, a set of mounting holes are first drilled into the base of the pontoon these holes enable the mounting braces 14, the plurality of standoffs 13, and the baseplate 11 to be attached to the pontoon in locations that facilitate retaining the winch 1 and the support arm 3 in positions that enable the anchor 5 to be deployed at will. Once mounting holes are drilled the plurality of standoffs 13 may be used to mount the baseplate 11 and the mounting braces 14 to the attached to the pontoon. In some embodiments, the baseplate 11 and the mounting braces 14 are fastened directly to the pontoon. Because there may be multiple layers of material through which the mounting holes must be drilled, plusnuts, crossnuts, and other width-adjustable fasteners may be used to attach the present invention to the pontoon. Preferably, a plurality of slotted holes 15 traverses through the baseplate 11 such that each of the plurality of slotted holes 15 is positioned at a corner of the baseplate 11. Thus positioned, the plurality of slotted holes 15 enables the baseplate 11 to be attached to the underside of the pontoon and repositioned when being mounted onto pontoons of varying shape and size. A plurality of winch-mounting holes 16 traverses through the baseplate 11 to enable the winch 1 to be attached to the baseplate 11. In some embodiments, a corresponding set of holes traverse through a base of the winch 1 to be attached to the baseplate 11 by fasteners.

Figure 4:
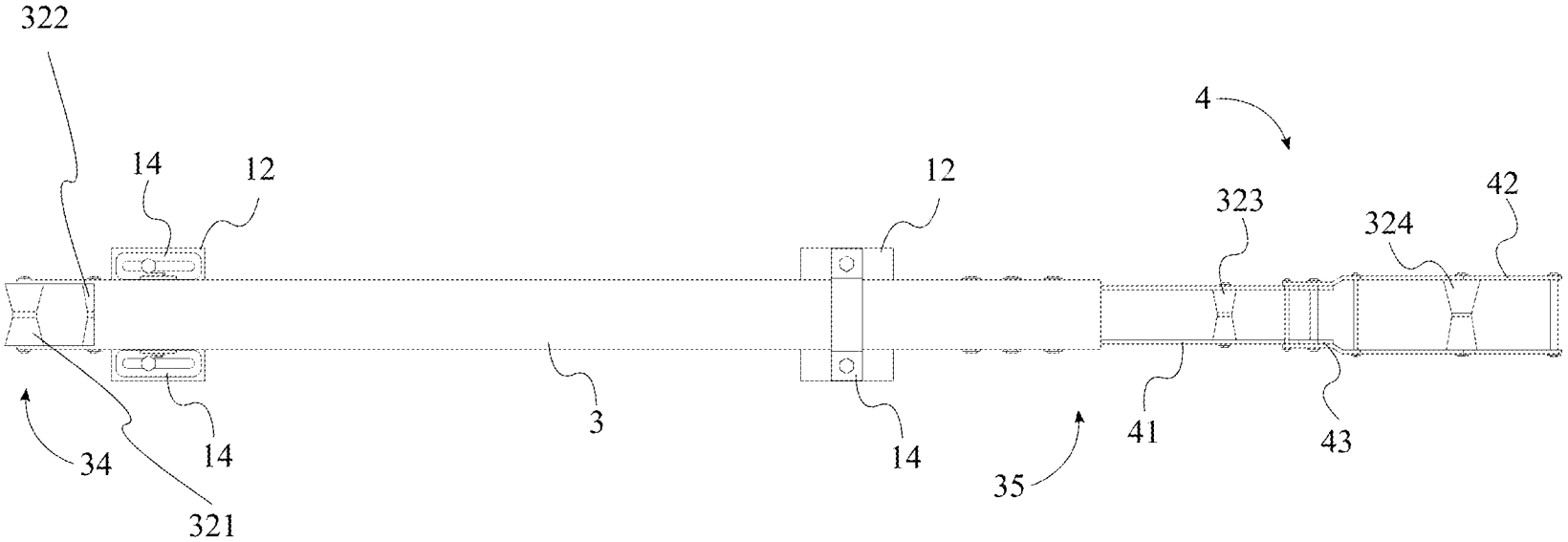
FIG. 4 is a bottom view of the present invention.

Referring to FIG. 4 and FIG. 5, preferably, a plurality of adjustment holes traverse through the support arm 3. Thus, enabling L-shaped mounting braces 14 to attach the support arm 3 to the pontoon. Embodiments of the present invention, feature mounting braces 14 of varying shape and size. Some embodiments are equipped with mounting braces that include an L-shaped brace system and a U-shaped brace. The L-shaped brace system comprises a pair of L-shaped brackets that are fastened onto opposite lateral sides of the support arm 3 and are used to mount the present intention onto external structures. Preferably, a bolt is threaded through the L-shaped brackets and the plurality of adjustment holes to affix the brackets to the support arm 3. This multicomponent bracket system enables the present invention to be mounted onto a wide variety of structures.

Although the invention has been explained in relation to its preferred embodiment, it is to be understood that many other possible modifications and variations can be made without departing from the spirit and scope of the invention as hereinafter claimed.

What is claimed is:

1. An anchor winch system comprising:
a support arm;
an end effector;
a guide channel;
a winch;
a cable;
an anchor;
the end effector being mounted adjacent to a first end of the support arm;
the guide channel longitudinally traversing through the support arm
a first end of the cable being tethered to the winch;
the cable being threaded through the guide channel;
a second end of the cable being tethered to the anchor.

2. The anchor winch system as claimed in claim 1 comprising:
a plurality of guide rollers;
the plurality of rollers being mounted within the guide channel;
the cable being routed over the plurality of rollers.

3. The anchor winch system as claimed in claim 2 comprising:
the plurality of guide rollers comprising at least one lift roller and at least one tensioning roller;
the lift roller being mounted adjacent to a second end of the support arm, opposite to the end effector;
the tensioning roller being mounted within the guide channel;
the tensioning roller being positioned in between the lift roller and the end effector;
the tensioning roller being positioned opposite to the lift roller across the guide channel;
the cable being threaded in between the lift roller and the tensioning roller.

4. The anchor winch system as claimed in claim 1 comprising:
the end effector comprising a first leg, a second leg, and an anchor-receiving hole;
the first leg being terminally mounted to the first end of the support arm;
the second end being terminally mounted to the first leg, opposite to the support arm;
the anchor-receiving hole traversing through the second leg.

5. The anchor winch system as claimed in claim 4 comprising:
at least one directional roller;
at least one anchor-support roller;
the directional roller being mounted to the first leg;
the anchor-support roller being mounted to the second leg;
the anchor-support roller being positioned in between the anchor-receiving hole and the first leg.

6. The anchor winch system as claimed in claim 4 comprising:
the end effector further comprising a stopper;
the second leg being hingedly attached to the first leg;
the stopper being mounted adjacent to the first leg.

7. The anchor winch system as claimed in claim 4 comprising:
the first leg being angularly offset from the support arm;
the second leg being angularly offset from the first leg.

8. The anchor winch system as claimed in claim 4, wherein a shank of the anchor engaging into the anchor-receiving hole.

9. The anchor winch system as claimed in claim 4, wherein the support arm is a length-adjustable member.

10. The anchor winch system as claimed in claim 1 comprising:
at least one mounting brace;
the mounting brace being laterally mounted to the support arm.

11. The anchor winch system as claimed in claim 1 comprising:
a first plurality of standoffs;

the plurality of standoffs being laterally mounted to the support arm.

12. The anchor winch system as claimed in claim 1 comprising:

a baseplate;

a second plurality of standoffs;

the winch being mounted adjacent to the baseplate;

the second plurality of standoffs being mounted adjacent to the baseplate, opposite to the winch.

13. The anchor winch system as claimed in claim 1 comprising:

a plurality of slotted holes;

a plurality of winch-mounting holes;

the plurality of slotted holes traversing through the base plate;

each of the plurality of slotted holes being positioned at a corner of the base plate;

the plurality of winch-mounting holes traversing through the baseplate;

the plurality of winch-mounting holes being positioned around a center point of the baseplate.

* * * * *